US010844633B2

(12) United States Patent
Qiu

(10) Patent No.: US 10,844,633 B2
(45) Date of Patent: Nov. 24, 2020

(54) PUSH-PULL PASSAGE LOCK MOUNTING DEVICE ADAPTED TO DOORS IN VARIOUS SIZES

(71) Applicant: CMECH (GUANGZHOU) LTD., Guangzhou (CN)

(72) Inventor: Jia Sen Qiu, Guangzhou (CN)

(73) Assignee: CMECH (GUANGZHOU) LTD., Guangdong (CN)

( * ) Notice: Subject to any disclaimer, the term of this patent is extended or adjusted under 35 U.S.C. 154(b) by 434 days.

(21) Appl. No.: 15/796,102

(22) Filed: Oct. 27, 2017

(65) Prior Publication Data

US 2018/0363329 A1 Dec. 20, 2018

(30) Foreign Application Priority Data

Jun. 19, 2017 (CN) ..... 2017 2 0717203 U

(51) Int. Cl.
*E05B 63/00* (2006.01)
*E05B 15/02* (2006.01)
*E05B 9/08* (2006.01)

(52) U.S. Cl.
CPC ..... *E05B 63/006* (2013.01); *E05B 9/08* (2013.01); *E05B 15/02* (2013.01)

(58) Field of Classification Search
CPC . Y10T 292/82; Y10T 292/85; Y10T 292/858; Y10T 292/861; Y10T 292/876; Y10T 292/869; Y10T 292/91; Y10T 70/8838; Y10T 292/57; E05B 63/0056; E05B 63/006; E05B 9/08; E05B 9/082; E05B 9/002; E05B 9/045; E05B 15/02; E05B 2001/0076; E05B 7/00; Y10S 292/53; Y10S 292/54; Y10S 292/60
See application file for complete search history.

(56) References Cited

U.S. PATENT DOCUMENTS 2,729,485 A * 1/1956 Schlage ..... E05B 3/065 292/1
3,992,908 A * 11/1976 Crepinsek ..... E05B 9/08 70/370
4,530,223 A 7/1985 Oliver
(Continued)

FOREIGN PATENT DOCUMENTS

AU 441480 9/1972
EP 3290622 A1 * 3/2018 ..... E05B 9/045

OTHER PUBLICATIONS

Computer Generated Translation for EP 3290622 A1, Generated on Feb. 3, 2020, https://worldwide.espacenet.com/patent/search (Year: 2020).*

*Primary Examiner* — Alyson M Merlino
(74) *Attorney, Agent, or Firm* — McKee, Voorhees & Sease, PLC

(57) ABSTRACT

A push-pull passage lock mounting device is provided for use with doors of various thicknesses. The device, which comprises a first mounting plate, a second mounting plate, adjusting inserts, a central actuator block, a first threaded stud connected with the first mounting plate, a second threaded stud connected with the second mounting plate. The adjusting inserts are sleeved on the first threaded stud or the second threaded stud. The distance between the first mounting plate and the second mounting plate can be adjusted via the inserts so as to adapt to doors with various thicknesses.

26 Claims, 5 Drawing Sheets

(56) References Cited

U.S. PATENT DOCUMENTS

| | | | | | |
|---|---|---|---|---|---|
| 4,732,418 | A * | 3/1988 | Crown | E05B 15/02 | 292/152 |
| 5,265,924 | A * | 11/1993 | Kim | E05B 3/065 | 292/336.3 |
| 5,322,333 | A * | 6/1994 | Norton, II | E05B 55/005 | 292/336.3 |
| 5,335,948 | A * | 8/1994 | Norton, II | E05B 3/065 | 292/169.23 |
| 5,727,406 | A * | 3/1998 | Banducci | E05B 3/065 | 292/336.3 |
| 5,761,936 | A * | 6/1998 | Katayama | E05B 15/02 | 292/336.3 |
| 5,947,535 | A * | 9/1999 | Baker | E05C 1/12 | 292/165 |
| 6,264,255 | B1 * | 7/2001 | Fortune | E05B 3/00 | 292/336.3 |
| 6,598,440 | B1 * | 7/2003 | Armstrong | E05B 15/02 | 292/336.3 |
| 6,616,203 | B1 * | 9/2003 | Lenk | E05B 3/06 | 292/336.3 |
| 6,619,710 | B1 * | 9/2003 | Hwang | E05B 63/006 | 292/336.3 |
| 2007/0096479 | A1 * | 5/2007 | Lin | E05B 9/08 | 292/336.3 |
| 2015/0076845 | A1 | 3/2015 | Ou et al. | | |
| 2017/0275917 | A1 * | 9/2017 | Murphy | E05B 63/0056 | |
| 2018/0238081 | A1 * | 8/2018 | Monaghan | E05B 63/006 | |
| 2018/0363322 | A1 * | 12/2018 | Qiu | E05B 9/08 | |

* cited by examiner

PUSH-PULL PASSAGE LOCK MOUNTING DEVICE ADAPTED TO DOORS IN VARIOUS SIZES

CROSS-REFERENCE TO RELATED APPLICATIONS

This application claims priority to Chinese Patent Application No: 201720717203.1, filed Jun. 19, 2017, which is herein incorporated by reference in its entirety.

FIELD OF THE INVENTION

This invention relates to a push-pull passage lock mounting device adapted to be installed on doors having different thicknesses.

BACKGROUND OF THE INVENTION

In the prior art, there are many kinds of door locks, including a push-pull passage lock. The push-pull passage lock generally comprises a latch plunger or bolt, a sliding frame connected to the latch bolt and a cam configured inside the sliding frame, wherein the cam rotates and drives the sliding frame to rotate, whereby the latch bolt connected to the sliding frame is driven to retract. A reset spring resets the sliding frame to its normal, at rest position. The sliding frame, the cam and the reset spring are all configured inside the housing, and the push-pull passage lock is mounted to a door through two cover plates on the housing. Existing push-pull passage locks have the followings drawbacks:

(1) A push-pull passage lock has a constant or fixed distance between the two cover plates and cannot be adapted to doors with various thicknesses, which brings inconvenience for users to select a lock cylinder.

(2) Lock cylinders in various sizes are needed to adapt to doors with various thicknesses due to the fixed distance between the cover plates, and thus various manufacturing molds are needed, which is a waste of resources and labors.

Therefore, a primary objective of the present invention is the provision of a push-pull door lock which accommodates doors having various thicknesses.

Another objective of the present invention is the provision of a push-pull door lock which is easy to adjust to mount on doors having different thicknesses.

A further objective of the present invention is the provisional of an adjustable push-pull door lock which is economical to manufacture, and durable in use.

These and other objectives will become apparent from the following description of the invention.

SUMMARY OF THE INVENTION

The present invention is directed to a door handle assembly, and particularly a push-pull passage lock mounting device adapted for use on doors, wherein the distance between a first mounting plate and a second mounting plate is adjustable so as to adapt to doors having various thicknesses.

The present invention provides a technical solution as follows:

A push-pull passage lock mounting device adapted to doors in various sizes comprises a handle assembly with a first mounting plate, a second mounting plate, an adjusting ring or insert, and a central actuator block. A first threaded stud or fastener threads into the first mounting plate and is configured on the actuator block along the longitudinal axis of the handle assembly. Preferably, there are a pair of first studs oriented 180° from one another, and a pair of second studs also spaced 180° apart, as well as a pair of inserts. The adjusting inserts are mounted or sleeved on the first threaded studs or the second threaded studs. The adjusting insert is 'Ω-shaped so as to fit over the first or second stud.

A first actuator housing and a second actuator housing are joined together by a mounting column or fastener and fastened on opposite two sides of the actuator block. The mounting fastener column comprises a body and a threaded end, wherein the body resides between the first actuator housing and the second actuator housing, and the threaded end protrudes from the first actuator housing to form the first threaded stud.

A mounting post or boss is further configured, wherein one end of the boss is threadably connected to the first threaded stud, while the other end is provided with a protruding column which extends through the first mounting plate and is swaged or otherwise attached.

The mounting post further comprises a head which extends through the second mounting component and is in threaded-connection with a screw. The screw passes through the second mounting plate and is threaded into the head. The threaded section of the screw forms the second threaded stud.

The first mounting component and second actuator housings are fastened together by bolts or screws on opposite sides of the actuator block.

The screw, the mounting post, and a boss are further configured, wherein the mounting post is threaded into the boss. The mounting post comprises a head and tail, and the tail forms a first threaded stud. One end of the boss is in threaded-connection with the first threaded stud, while the other end is provided with a protruding column to which the first mounting plate is fastened. The screw passes through the second mounting plate and threads into the head. The threaded section of the screw forms the second threaded stud.

A first cover plate and a second cover plate are provided, wherein the first cover plate is in snap-fit or twist fit connection with the first mounting plate and the second cover plate is in snap-fit or twist fit connection with the second mounting plate.

An elastic or resilient piece or tab is arranged at the edge of the first mounting plate, a projection or detent is provided at the inner wall of the sidewall of the first cover plate, and elastic tab of the first mounting plate is in snap-fit or twist fit connection with the projection of the first cover plate. An elastic or resilient tab is arranged at the edge of the second mounting plate, a projection or detent is provided at the inner wall of the sidewall of the second cover plate, and the elastic tab of the second mounting plate is in snap-fit or twist fit connection with the projection of the second cover plate. Preferably there are at least two detents and tabs on each cover plate and mounting plate.

By applying the above-mentioned technical solution, the invention has achieved the following benefits:

(1) For a push-pull passage lock mounting device adapted to doors in various sizes of this invention, an adjusting ring can be sleeved on the first threaded stud or the second threaded stud to adjust the distance between the first mounting plate and the second mounting plate, so as to adapt to the thickness of a door. For example, when a door has a small thickness, the adjusting rings or inserts can be taken off or the heights of the adjusting ring can be changed so as to adapt to the thickness of the door;

(2) The cross section of the adjusting ring or insert is 'Ω-shaped, for quick snap fit onto the studs, which brings convenience to disassembly and assembly;

(3) The first cover plate is in snap-fit or twist fit connection with the first mounting plate, and the second cover plate is in snap-fit or twist connection with the second mounting plate, such that the assembly process is convenient; and furthermore, the installing parts can be covered, thus bringing improved appearance to the lock.

DETAILED DESCRIPTION OF THE PREFERRED EMBODIMENTS

Figure 1:
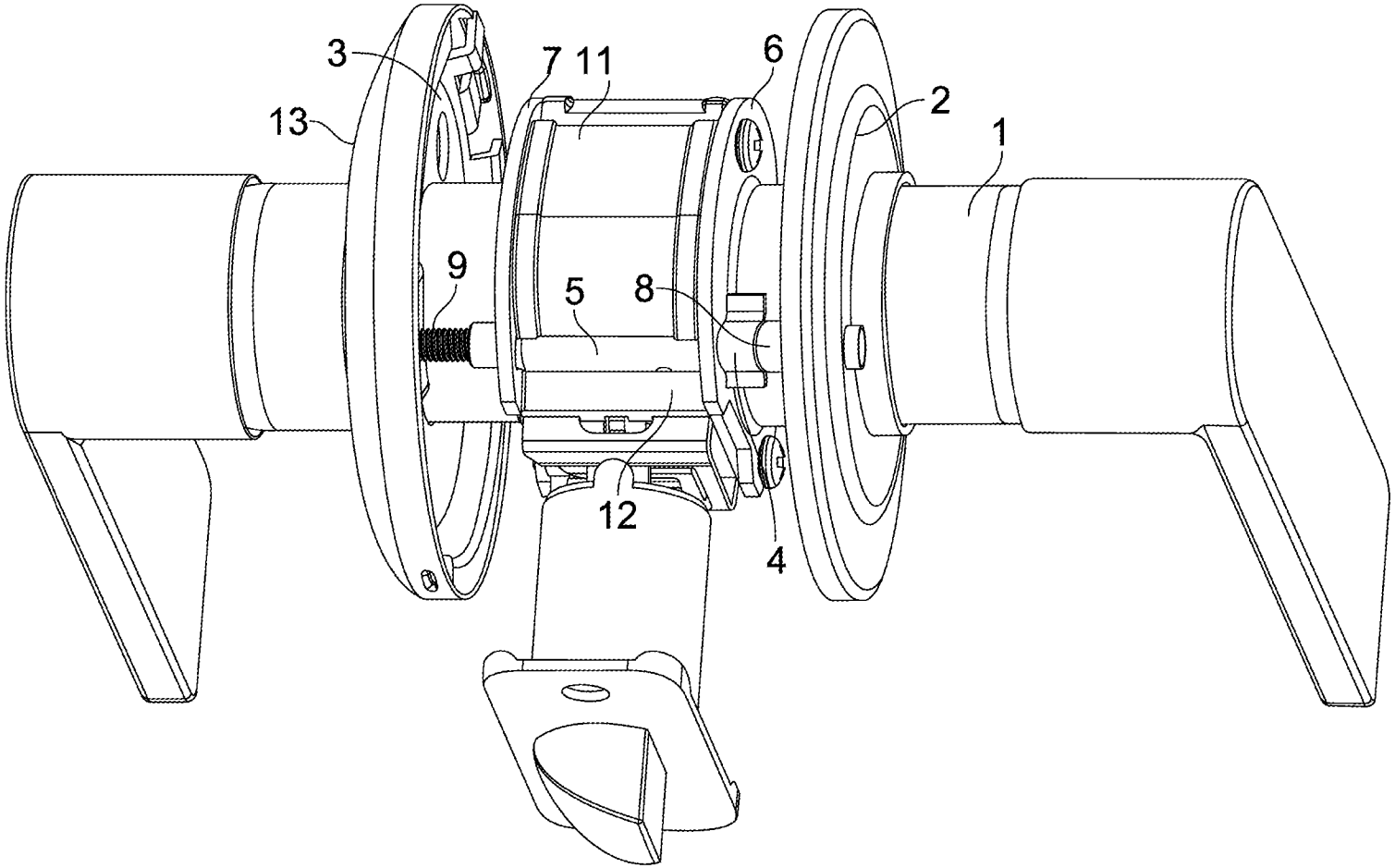
FIG. 1 is perspective view of a push-pull passage lock mounting device adapted to doors in various sizes, according to the invention.

As shown in the drawings, this invention provides a handle assembly 1 for a door and specifically, a push-pull passage lock mounting device adapted to doors in various sizes. The assembly 1 comprises a first mounting plate 2, a second mounting plate 3, and a pair of adjusting rings or inserts. 4. The assembly 1 protrudes radially outwardly in its middle to form an actuator block 11. A pair of first mounting columns comprising threaded studs 5 are connected with the first mounting plate 2, and configured on one side of the actuation block 11, extending along the length direction of the assembly 1. A pair of second threaded studs 9 connected with the second mounting plate 3, is configured on the opposite side of the actuator block 11, extending along the length direction of the assembly 1. The adjusting inserts 4 are sleeved on the first threaded studs 5 or the second threaded studs 9, and the distance between the first mounting plate 2 and the second mounting plate 3 can be adjusted by use of the inserts 4. When a door has a big thickness, and inserts 4 can be installed or sleeved on the first threaded studs 5 or the second threaded studs 9 to adjust the distance between the first mounting plate 2 and the second mounting plate 3 so as to adapt to the thickness of a door. When a door has a small thickness, the inserts 4 can be taken off or inserts with a smaller height can be used so as to adapt to the thickness of the door.

Figure 2:
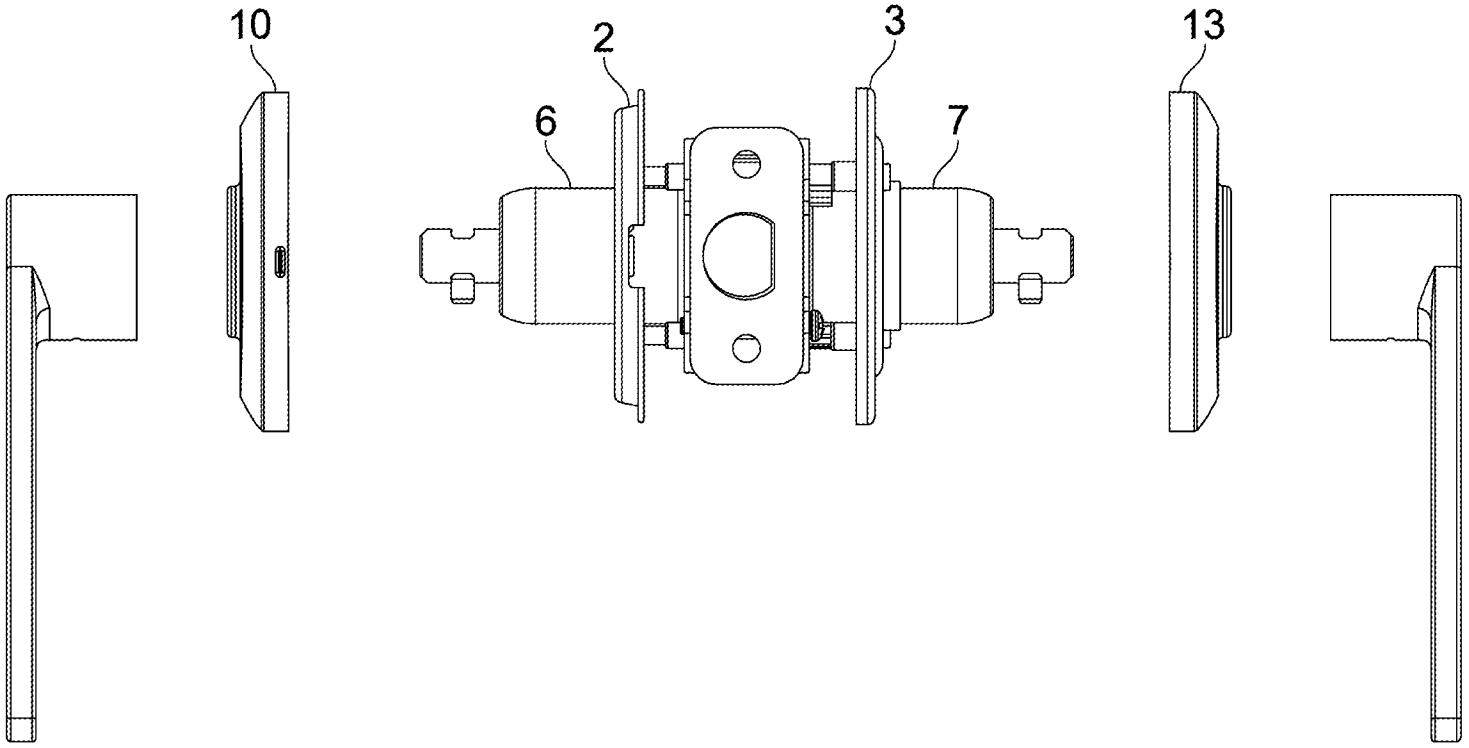
FIG. 2 is a partially exploded view of the push-pull passage lock mounting device adapted to doors in various sizes, according to the invention.

As shown in FIG. 1 and FIG. 2, the actuation block 11 resides in the middle of the housing 1. At least one opening or recess 12 is arranged to extend axially through or along the actuation block 11, and the mounting column 5 resides in the opening. A first actuator housing 6 and a second actuator housing 7, arranged at the two ends of the opening 12, are sleeved on the actuator and are located at the two sides of the actuator block 11 respectively. The first actuator housing 6 and the second housing 7 each include a cylindrical body 6A, 7A and a radial flange 6B, 7B. The housings 6, 7 are fastened together by bolts.

The mounting column 5 comprises a head 51, a body 52 and a threaded tail 53, wherein the body 52 is clamped and fastened between the first actuator housing 6 and the second actuator housing 7, and the threaded end 53 protrudes through the first flange 6B to form the first threaded stud 5. One end of the mounting boss 8 is in threaded connection with the first threaded stud 5, while the other end is provided with a protruding column on which the first mounting plate 2 is sleeved and is fastened in any convenient manner, such as by swaging or by a nut. The head 51 is configured outside the second mounting component 7 and is in threaded connection with the screw 9. The screw 9 passes through the second mounting plate 3 and is in threaded connection with the head 51. The threaded section of the screw 9 forms the second threaded stud. The first threaded stud 5 or the second threaded stud 9 is provided with the adjusting ring or insert 4 which has a 'Ω-shaped cross section and is elastic, for convenience in disassembly and assembly.

Figure 3:
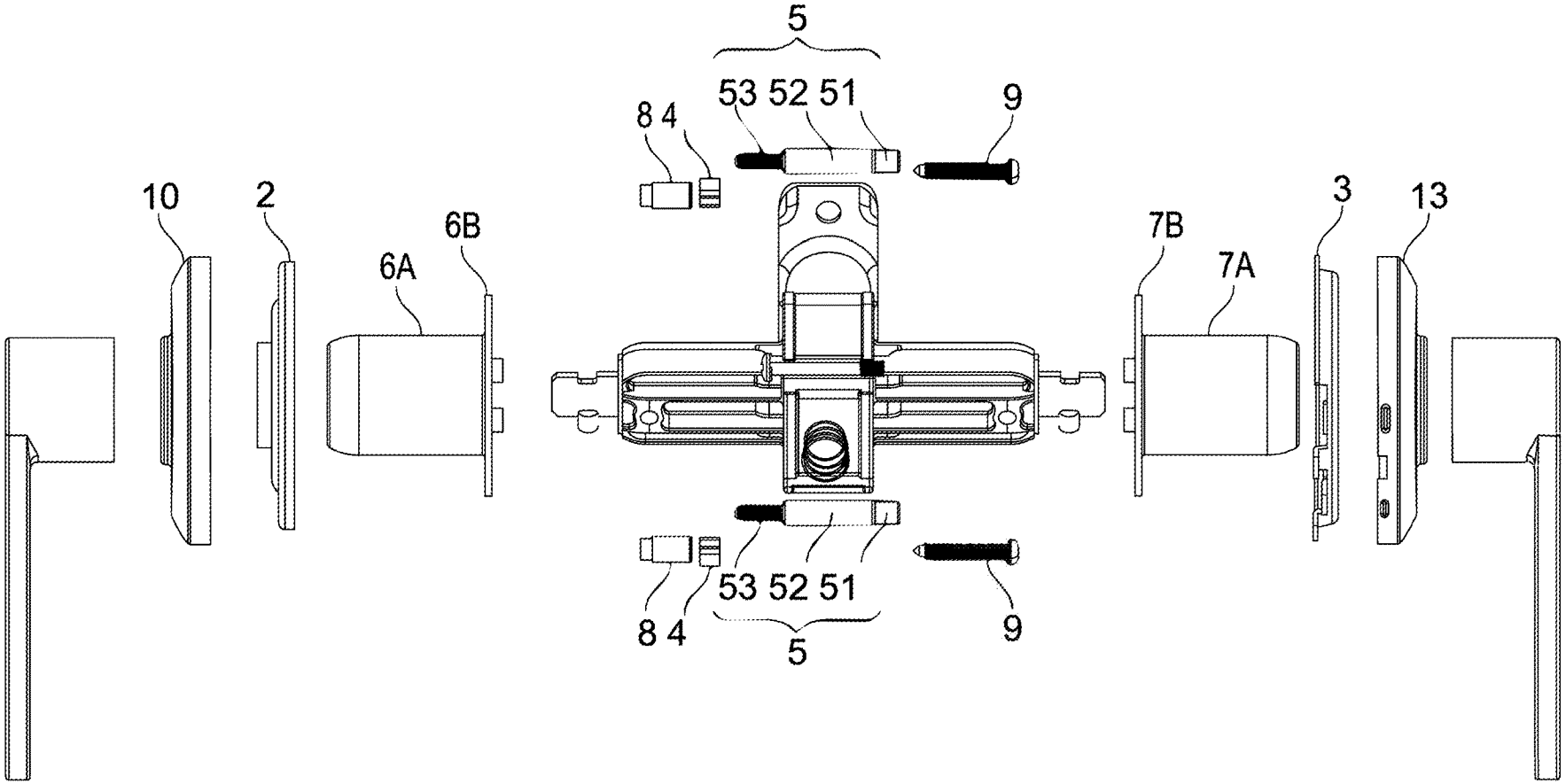
FIG. 3 is another further exploded view of the push-pull passage lock mounting device, according to the invention.
Figure 4:
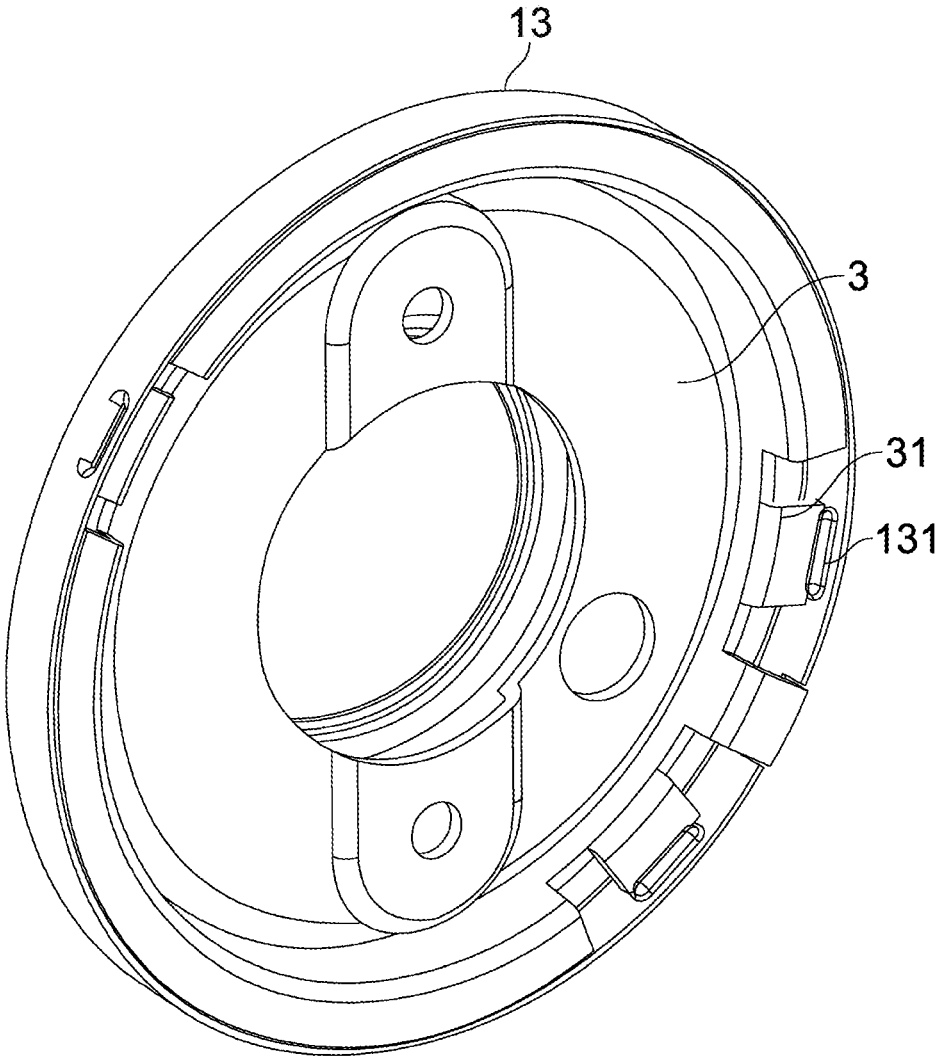
FIG. 4 is a perspective view of the second cover plate of the push-pull passage lock mounting device adapted to doors in various sizes according to the invention.
Figure 5:
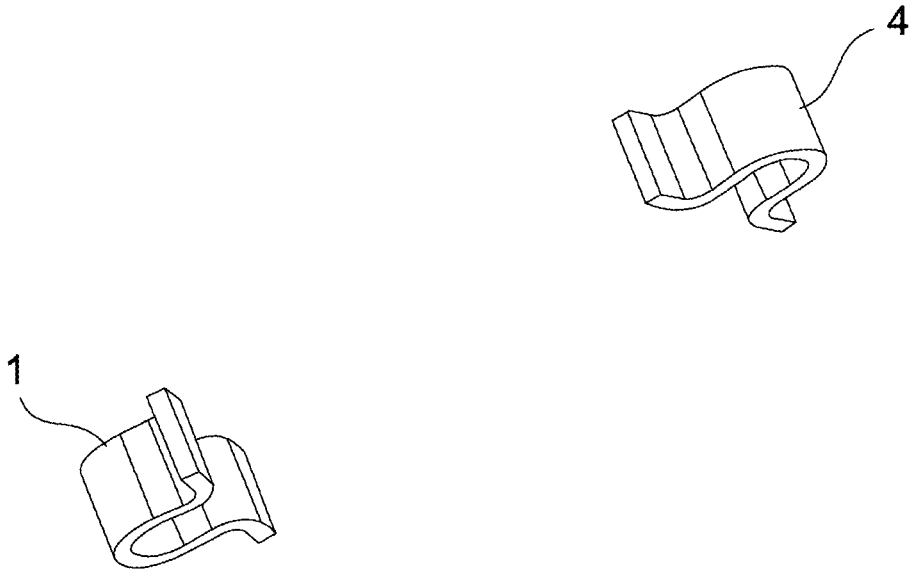
FIG. 5 is a perspective view of the inserts used in the push pull door handle lock assembly of the present invention.

In order to cover the screws 8 so as to improve the aesthetic appearance, a first cover plate 10 is mounted over the first mounting plate 2, and a second cover plate 13 is mounted over second mounting plate 3. The first cover plate 10 is in snap-fit or twist-fit connection with the first mounting plate 2, while the second cover plate 13 is in snap-fit or twist-fit connection with the second mounting plate 3. For example, as shown in FIG. 3, the second cover plate 13 is dome-shaped, and comprises a dome plate and a sidewall configured around the edge of the dome plate. A projection or detent 131 is provided at the inner wall of the sidewall of the second cover plate 13, and an elastic piece or tab 31 is provided adjacent the edge of the second mounting plate 3. During installation, the tab 31 of the second mounting plate 3 is buckled into the projection 131 of the second cover plate 13. The first cover plate 10 has the same structure as the second cover plate 13, and the snap-fit or twist-lock structure between the first cover plate 10 and the first mounting plate 2 is the same as that between the second mounting plate 3 and the second cover plate 13. A projection or detent 131 is also provided at the inner wall of the sidewall of the first cover plate 10, and an elastic tab 31 is also provided at the inner wall of the sidewall of the first cover plate 10, and an elastic tab 31 is arranged at the edge of the first mounting plate 2. During installation, the elastic tab 31 of the first mounting plate 2 is buckled into or overlapped with the projection 131 of the first cover plate 10. Thus, the first cover plate 10 is in snap-fit or twist-locked connection with the first mounting plate 2.

The push-pull door handle lock assembly of the present invention is further described in concurrently filed application Ser. No. 15/796,352, entitled PUSH-PULL PASSAGE LOCK HOUSING and Ser. No. 15/796,550, entitled PUSH-PULL PASSAGE LOCK, which are incorporated by reference herein in their entireties.

It should be appreciated that the embodiment described hereinbefore is merely preferred embodiment of the present invention and not for purposes of any restrictions or limitations on the invention. Therefore, any simple amendments, equivalent variants and modifications to above embodiments according to the technical essence of the present invention, without departing from the technical solution of the present invention, should be incorporated into ambit of claims of the present invention.

What is claimed is:

1. A push/pull passage lock assembly comprising:

a first mounting plate;

a second mounting plate;

an actuator between the first and second mounting plates and connected to interior and exterior handles of a push/pull passage lock for operation by pushing or pulling either one of the phrase the interior and exterior handles;

a pair of first studs threaded into the first mounting plate and extending along opposite side walls of the actuator;

a pair of second studs extending through the second mounting plate and threaded into the first studs;

a pair of adjusting inserts on the first studs or the second studs to adjust a spacing between the first and second mounting plates;

the adjusting inserts have a cylindrical body with an opening to receive one of the first or second studs and outwardly extending legs on opposite sides of the cylindrical body; and whereby the push/pull lock assembly is mountable on doors having different thicknesses.

2. The push/pull passage lock assembly according to claim 1, further comprising a first actuator housing and a second actuator housing, wherein each of the pair of first studs comprises a mounting column, the first and second actuator housings being sleeved on opposite sides of the actuator, each mounting column comprises a body and a threaded end, wherein the body resides between the first and second actuator housings and the threaded end protrudes from the first actuator housing.

3. The push/pull passage lock assembly according to claim 2, further comprising a pair of mounting bosses, each having one end connected to a corresponding one of the pair of first studs, and another end fastened to the first mounting plate.

4. The push/pull passage lock assembly according to claim 2, wherein each mounting column further comprises a head residing outside the second actuator housing and is in threaded connection with a screw; the screws pass through the second actuator housing and each is in threaded connection with the body of a corresponding one of the mounting columns, and the screws forming the pair of second studs.

5. The push/pull passage lock assembly according to claim 2, wherein the first actuator housing and the second actuator housing are fastened together.

6. The push/pull passage lock assembly according to claim 2, further comprising screws and mounting bosses, wherein the mounting columns are fastened to the mounting bosses; wherein the body and the threaded end of each of the mounting columns are configured at opposite sides of the first actuator housing; one end of each of the mounting bosses is in threaded-connection with a corresponding one of the first studs, while another end is fastened to the first mounting plate; the screws pass through the second mounting plate and are in threaded-connection with the mounting columns; the screws are provided with a threaded section forming the pair of second studs.

7. The push/pull passage lock assembly according to claim 1, further comprising a first cover plate and a second cover plate, the first cover plate having a twist connection with the first mounting plate and the second cover plate having a twist connection with the second mounting plate.

8. The push/pull passage lock assembly according to claim 7, further comprising an elastic tab at an edge of the first mounting plate, a projection on an inner wall of a sidewall of the first cover plate, and the elastic tab of the first mounting plate is in connection with the projection of the first cover plate; and an elastic tab is arranged at an edge of the second mounting plate, a projection is provided at an inner wall of a sidewall of the second cover plate, and the elastic tab of the second mounting plate having a twist connection with the projection of the second cover plate.

9. The push/pull passage lock mounting device of claim 1 wherein the adjusting inserts limit threading of the first or second studs onto the first mounting plate and thereby adjust the spacing between the first and second mounting plates.

10. A push-pull handle assembly for a door, the push-pull handle assembly comprising:

an actuator operably connected to opposite handles such that pushing or pulling either of the handles actuates the actuator to open the door;

a pair of housings on opposite sides of the actuator;

a pair of mounting plates mounted over the housings;

a pair of fasteners extending through the plates to secure the plates together; and a pair of inserts selectively mounted on the fasteners to adjust spacing between the mounting plates to adapt the push-pull handle assembly for mounting on doors having various thicknesses; wherein the inserts have opposing legs connected by an arch with an opening for receipt of the fasteners.

11. The handle assembly of claim 10 wherein the opposite handles are mounted to the housings and operatively connected to the opposite sides of the actuator so as to actuate the actuator when either one of the handles is pushed or pulled.

12. The handle assembly of claim 10 wherein each fastener includes a mounting column having a first end secured to one of the mounting plates and a screw extending through the other one of the mounting plates and into a second end of the mounting column.

13. The handle assembly of claim 12 wherein the first end of each mounting column has external threads to thread into a boss on the one of the mounting plates and each mounting column includes internal threads to threadably receive the screw.

14. The handle assembly of claim 10 wherein the pair of inserts are exchangeable for a second pair of inserts having a different height for used on a second door having a different thickness than the door.

15. The handle assembly of claim 10 further comprising a pair of cover plates mounted over the mounting plates.

16. The handle assembly of claim 15 wherein one of the cover plates is mounted to a corresponding one of the mounting plates by twisting the one of the cover plates onto the corresponding one of the mounting plates.

17. The handle assembly of claim 16 wherein the one of the cover plates and the corresponding one of the mounting plates have overlapping tabs and detents.

18. The handle assembly of claim 17 wherein the overlapping tabs and detents comprise inwardly extending projections on the one of the cover plates and outwardly extending tabs on the one of the one of the corresponding mounting plates to retentively engage the projections.

19. The handle assembly of claim 10 wherein the housings each include a cylindrical body and a perimeter flange.

20. The push-pull handle assembly of claim 10 wherein the inserts limit extension of the fasteners into the mounting plates for adjusting the spacing between the mounting plates.

21. A push-pull passage lock for a door, and having interior and exterior handles, the push-pull passage lock comprising:

a pair of mounting plates;

an actuator between the mounting plates and operatively connected to the interior and exterior handles such that pushing or pulling either one of the interior and exterior handles operate the actuator;

fasteners for securing the actuator between the mounting plates; and split spacers selectively mounted on the fasteners to adjust a spacing between the mounting plates to adapt the push-pull passage lock so as to accommodate doors having different thicknesses;

each of the split spacers have a rounded body with opposing legs extending from the body.

22. The push-pull passage lock of claim 21 wherein the fasteners include two sets of threaded connectors and the split spacers are mountable on both sets of connectors.

23. The push-pull passage lock of claim 21 wherein each split spacer has a side wall with an opening therein.

24. The push-pull passage lock of claim 21 wherein each of the split spacers is a partial ring.

25. The push-pull passage lock of claim 21 wherein the split spacers include first and second sets and the first set is bigger than the second set.

26. The push-pull passage lock of claim 21 wherein the split spacers limit extension of the fasteners into the mounting plates and thereby adjust the spacing between the mounting plates.

* * * * *